United States Patent [19]

Baron et al.

[11] 4,053,730

[45] Oct. 11, 1977

[54] MICROWAVE OVEN SHAFT SEAL

[75] Inventors: David Alan Baron, Edina; Donald Carl Naab, Plymouth; James Ronald Hampton, Brooklyn Center, all of Minn.

[73] Assignee: Litton Systems Inc., Beverly Hills, Calif.

[21] Appl. No.: 686,709

[22] Filed: May 17, 1976

[51] Int. Cl.[2] ..... H05B 9/06

[52] U.S. Cl. ..... 219/10.55 F

[58] Field of Search ..... 219/10.55 F, 10.55 R, 219/10.55 D; 174/35 R, 35 GC, 35 C

[56] References Cited

U.S. PATENT DOCUMENTS

| | | | |
|---|---|---|---|
| 3,431,381 | 3/1969 | Anderson | 219/10.55 F |
| 3,783,219 | 1/1974 | Tateda | 219/10.55 D |

*Primary Examiner*—Arthur T. Grimley

*Attorney, Agent, or Firm*—Robert E. Lowe

[57] ABSTRACT

A microwave oven having an energy stirrer including a drive shaft extending through a wall of the oven is disclosed. A microwave energy seal in the form of a metallic disc is provided to prevent energy leakage at the drive shaft aperture.

12 Claims, 3 Drawing Figures

FIG. 1
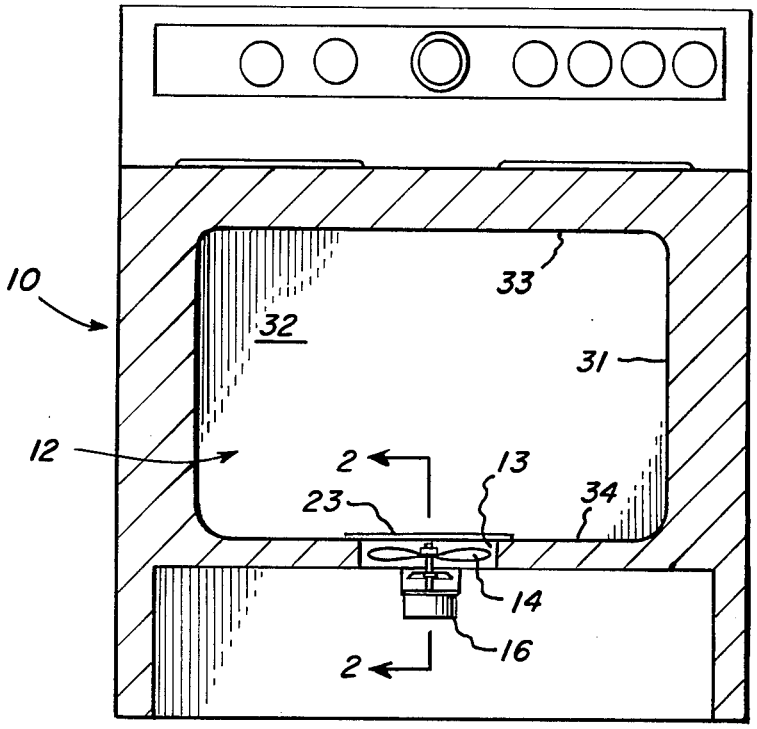
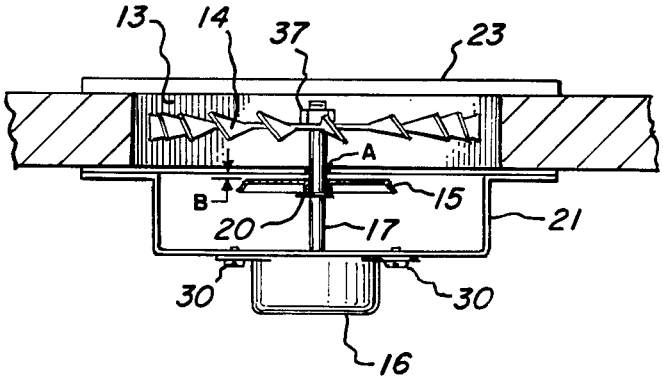
FIG. 2
FIG. 3
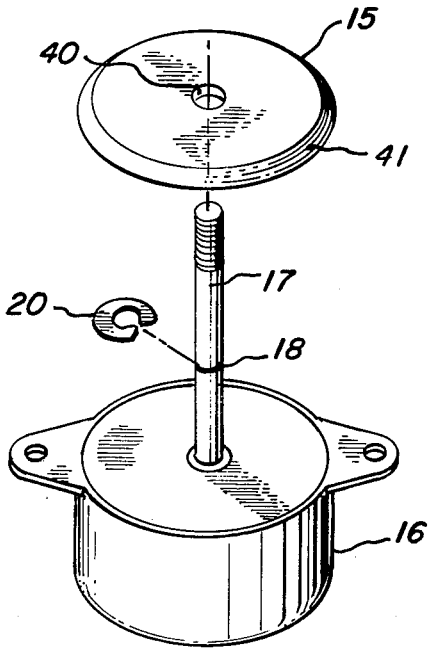

MICROWAVE OVEN SHAFT SEAL

BACKGROUND OF THE INVENTION

This invention relates to the field of microwave ovens and ranges, and more particularly to the field of energy seals to prevent the escape of microwave energy from the oven cavity. The invention is particularly well suited to combination cooking ranges wherein food may be cooked by the simultaneous application of both thermal and microwave energy.

Existing government standards require that leakage of microwave energy from microwave cooking appliances be kept to minimum levels. General oven design parameters seek to eliminate spaces through which microwave energy can escape beyond the cooking cavity.

Prior art microwave ovens and ranges have incorporated some type of energy deflector or stirrer located within the microwave energy field for the purpose of breaking up static patterns and providing for a more uniform energy distribution within the oven. Such deflectors or stirrers are often rotatable and require some type of motor for operation, which motor is normally mounted outside of the microwave energy field. In such applications, the motor is typically mounted directly to the exterior side of one oven wall, effectively blocking the aperture through which the motor shaft extends into the cavity, thereby preventing leakage at that point.

In some microwave ovens designs it is not practical to mount a stirrer motor directly to a cavity wall. In such cases, excessive microwave leakage can occur at the point where the motor shaft passes through the cavity wall. This problem can arise in the design of a combination cooking range wherein food may be cooked by the simultaneous application of both thermal energy and microwave energy. The use of thermal energy causes the oven walls to be heated to an extent that the stirrer motor cannot be mounted directly to an oven wall.

SUMMARY OF THE INVENTION

It is an object of the present invention to provide a microwave energy deflector having an improved energy seal to prevent microwave leakage in the area of the deflector motor drive shaft.

A further object of the invention is to provide an improved energy seal that is economical to manufacture and easy to assemble.

Other objects and advantages of the invention will become clear as the specification proceeds.

The present invention provides a microwave oven having a plurality of metal walls forming an oven cavity wherein microwave energy from an energy generating source is introduced into said cavity establishing a microwave energy field for heating. A rotatable energy deflector rotates in the energy field to enhance the energy pattern in the oven. A motor located outside of the energy field includes a drive shaft extending through a cavity wall to operate the deflector. A metallic disc is mounted on the drive shaft on the exterior side of the cavity wall and spaced from the wall so as to form a capacitive seal preventing leakage of microwave energy around the motor shaft.

BRIEF DESCRIPTION OF THE DRAWINGS

FIG. 1 is a schematic view partly in section of a combination microwave/thermal range showing the general location and mounting of the energy deflector and drive motor of the present invention;

FIG. 2 is an enlarged cross section taken along line 2—2 in FIG. 1 showing the detailed construction and mounting of the energy deflector, seal and motor; and FIG. 3 is an exploded view of the energy seal and deflector motor illustrating the locating and mounting technique.

DESCRIPTION OF PREFERRED EMBODIMENTS

FIG. 1 depicts a microwave range 10, and more particularly a microwave range of the type having an oven 12 wherein cooking can be accomplished through the simultaneous application of both conventional thermal energy and microwave energy. For the purpose of this specification such cooking is referred to as "combination cooking".

The oven 12 is formed in a conventional manner by the joining of metal walls to form a substantially box-like oven enclosure, specifically side walls 31, rear wall 32, top wall 33, and bottom wall 34. The oven cavity is closed for cooking by means of an oven door (not shown).

Bottom wall 34 includes a recessed portion 13 whose primary function is to provide a feedbox area for the introduction and distribution of microwave energy into oven 12. In practice, the recessed feedbox 13 may be provided as an integral part of bottom wall 34, formed during its manufacture, or it may be formed by the attachment of a separate box-like recess to the bottom of bottom wall 34. In any case, the top of recessed portion 13 is open to the oven 12 and microwave energy is able to freely pass from recessed portion 13 to oven 12.

In order to provide a smoother, more easily cleaned surface within oven 12, recessed portion 13 is covered by plate 23. Plate 23 is made from a suitable material which is essentially transparent to microwave energy and is able to withstand the cooking and cleaning temperatures that are present in oven 12. Typically, plate 23 is of a ceramic material.

A microwave energy deflector 14 is located within recessed portion 13. Deflectors of this type are frequently referred to as stirrers, and their function is to prevent the formation of undesirable standing patterns in oven 12 and to provide a more uniform microwave energy cooking pattern in the oven. Such deflectors are customarily made of a microwave reflective material, preferably an easily formable metal such as aluminum.

Deflector 14 is mounted on shaft 17 for rotation by motor 16. Any suitable mounting technique may be employed such as a pressfit, or the deflector 14 may be secured to shaft 17 by means of a nut 37. Shaft 17 passes through the bottom of recessed portion 13 of bottom wall 34 in the region designated A in FIG. 2.

In many microwave oven applications, the stirrer motor 16 may be mounted directly against the exterior surface of one of the cavity walls, as against the underside of bottom wall 34. However, this technique has been found to be unsuitable in a microwave range adapted for combination cooking. Because conventional thermal heat is used in such ranges, considerably higher temperatures are experienced at the oven walls than those normally encountered in microwave cooking alone. Such temperatures were found to create an unacceptable condition for motor 16 when mounted directly against bottom wall 34.

Accordingly, the structure of the present invention provides bracket 21 which is mounted to the underside of bottom wall 34 below recessed portion 13. Motor 16 is mounted to bracket 21 with suitable fasteners 30. Bracket 21 provides adequate spacing between bottom wall 34 and motor 16 to allow motor 16 to operate within an acceptable temperature range.

It was observed that by spacing motor 16 away from bottom wall 34, microwave energy leakage in the area around drive shaft 17 markedly increased; that area being designated generally by letter A in FIG. 2. Significantly decreasing the drive shaft aperture size at A was not considered to be a practical or optimum solution inasmuch as it may create manufacturing tolerances that make the formation and assembly of bottom wall 34, bracket 21 and motor 16 unnecessarily complex and costly.

Capacitive type seals have been used in the past in some types of microwave oven door construction wherein a seal plate is provided in the door to bear against the oven front, such plate sometimes being spring loaded to insure close contact. In such seals, either the plate or the oven front is painted, the paint providing the dielectric material between the metal surfaces.

A seal of the foregoing general construction would not appear to be feasible for the instant application. The cost and complexity would make such an arrangment impractical. Moreover, the fact that one of the surfaces forming the seal would rotate with respect to the other would dictate against the use of a seal based on physically close contact.

It was discovered that microwave leakage from area A could be remarkably reduced through the provision of a metal plate or disc in closely spaced relationship to the underside of bottom wall 34, although not in physical contact. Disc 15 contains an aperture 40 in its center adapted to fit over shaft 17. The shaft is notched as shown at 18, and clip 20 is fitted into notch 18 and around shaft 17. Disc 15 can then be dropped onto shaft 17 and will be vertically positioned on the shaft by clip 20 and notch 18.

Notch 18 and clip 20 are positioned on shaft 17 so as to provide an optimum spacing B between disc 15 and the underside of bottom wall 34 when bracket 21 and motor 16 are assembled in range 10. Dimension B must be sufficiently small to allow the structure to operate effectively as a capacitive seal, however it should not be so small that disc 15 can scrape against the underside of bottom wall 34. The latter tolerance takes into account the possibility that disc 15 may not be perfectly flat when manufactured in a quantity process such as stamping, punching, and the like.

When a microwave frequency of 2,450MHz is used in oven 12, it has been found that if dimension B exceeds 0.25 inches it will not provide sufficient capacitive sealing characteristics to reduce leakage to an acceptable amount. It is preferred that dimension B be about 0.125 inches or less for optinum benefits. Such a dimension is relatively easy to maintain as a manufacturing tolerance and gives entirely satisfactory leakage performance.

Disc 15 can be manufactured from any conductive material that is reflective of microwave energy and is susceptable to available manufacturing techniques. For example, disc 15 may be made from relatively thin gauge aluminum whereby the entire structure can be stamped out in a single step. In such cases, disc 15 may include flange portion 41 turned downwardly around the periphery of the disc. The flange portion 41 provides greater rigidity to the disc and aids in providing more consistent flatness.

It will be appreciated that the present invention provides an effective, economical solution to the problems attendant to mounting the stirrer motor away from a cavity wall. In the case of an oven adapted for combination cooking, such a step is necessitated by thermal considerations. However, the structure may be applied as well to microwave ovens wherein the stirrer motor is to be mounted away from a cavity wall in response to other design parameters and considerations. It will also be appreciated that although the shaft 17 in the present application is depicted attached to an electric motor 16, the shaft 17 can also be driven or rotated by any other suitable driving means by those skilled in the art without effecting the operation or scope of the invention.

While the structure of the shaft seal of the present invention has been described in considerable detail in the foregoing specification, it will be appreciated that such detail is for the purpose of illustration and is not intended to limit the scope of the invention which is defined in the appended claims. It will be further appreciated that many modifications can be made in the detailed structure shown by those skilled in the art without departing from the spirit or socpe of the invention.

We claim:

1. In a microwave oven having a plurality of metal walls and a door joined to form an oven cavity, a source of microwave energy adapted to provide a microwave energy field; energy deflecting means adapted for rotational movement in said energy field; driving means located outside of said cavity and having a shaft extending through one of said walls, said deflecting means being operably connected to said shaft, the improvement comprising energy seal means positioned on said shaft between said wall and said motor.

2. The apparatus of claim 1 wherein said energy seal means includes a metalic disc positioned on said shaft and spaced away from said wall.

3. The apparatus of claim 2 wherein said disc is spaced away from said wall a distance less than 0.25 inches.

4. The apparatus of claim 2 wherein said disc is spaced away from waid wall a distance of less than 0.125 inches.

5. The apparatus of claim 1 including a stop member located on said shaft for locating said energy seal means on said shaft.

6. A combination cooking range adapted to cook foods by simultaneous application of thermal energy and microwave energy, said range including an oven cavity having top, bottom, rear and side walls, said bottom wall including a recessed portion; energy deflecting means adapted for rotation within said recessed portion; driving means located outside of said oven cavity and spaced away from said recessed portion, and having a shaft extending through said bottom wall, said energy deflecting means being operably connected to said shaft; and microwave energy seal means positioned between said driving means and said bottom wall to prevent leakage of microwave frequency energy from said oven cavity in the area of said shaft.

7. The apparatus of claim 6 including bracket means attached to the underside of said bottom wall recessed portion, said driving means including a motor mounted to said bracket means.

8. The apparatus of claim 6 wherein said energy seal means comprises a substantially flat metal disc concentrically mounted on said shaft.

9. The apparatus of claim 8 wherein said disc includes a peripheral flange.

10. The apparatus of claim 8 wherein said disc is spaced away from the underside of said bottom wall a distance less than 0.25 inches.

11. The apparatus of claim 8 wherein said disc is spaced away from the underside of said bottom wall a distance of approximately 0.12 inches.

12. The apparatus of claim 8 including a stop member located on said shaft for locating said disc on said shaft.

* * * * *